US009682573B2

(12) United States Patent
Leighton

(10) Patent No.: US 9,682,573 B2
(45) Date of Patent: Jun. 20, 2017

(54) PRINTER HAVING EDGE CONTROL APPARATUS FOR WEB MEDIA

(75) Inventor: Roger G. Leighton, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 888 days.

(21) Appl. No.: 13/447,357

(22) Filed: Apr. 16, 2012

(65) Prior Publication Data

US 2013/0271542 A1 Oct. 17, 2013

(51) Int. Cl.
*B41J 11/00* (2006.01)
*B41J 15/04* (2006.01)

(52) U.S. Cl.
CPC ..... *B41J 11/0005* (2013.01); *B41J 15/04* (2013.01)

(58) Field of Classification Search
CPC . B41J 11/0055; B41J 11/0045; B41J 11/0005; B41J 15/04
USPC ..... 347/8, 14, 19, 101, 104; 271/272, 275, 271/264
See application file for complete search history.

(56) References Cited

U.S. PATENT DOCUMENTS 4,188,025 A * 2/1980 Gusfafson et al. ..... 271/314
4,217,682 A 8/1980 Young, Jr. et al.
5,094,442 A * 3/1992 Kamprath et al. ..... 271/227
6,259,888 B1 7/2001 Kazama et al.
7,523,933 B2 * 4/2009 Linder et al. ..... 271/274
7,677,558 B2 * 3/2010 Kinoshita et al. ..... 271/227
8,469,476 B2 * 6/2013 Mandel et al. ..... 347/16
2001/0040340 A1 * 11/2001 Neary et al. ..... 271/275
2003/0145967 A1 8/2003 Gafner et al.
2007/0045944 A1 3/2007 Ban et al.
2008/0019751 A1 * 1/2008 Castillo et al. ..... 399/406
2009/0035033 A1 * 2/2009 Chang ..... 399/328
2009/0257801 A1 10/2009 Miyoshi et al.
2009/0297196 A1 * 12/2009 Yamanaka et al. ..... 399/67
2010/0033529 A1 * 2/2010 Komuro ..... 347/16
2010/0123284 A1 * 5/2010 Herrmann ..... 271/227
2010/0253728 A1 * 10/2010 Yoshida et al. ..... 347/14
2010/0276877 A1 * 11/2010 Richards et al. ..... 271/264
2010/0327518 A1 * 12/2010 Tharayil ..... 271/227
2011/0049800 A1 3/2011 deJong et al.
2011/0052301 A1 * 3/2011 Crystal et al. ..... 400/621
2011/0062657 A1 * 3/2011 Williams et al. ..... 271/188

* cited by examiner

*Primary Examiner* — Alessandro Amari
*Assistant Examiner* — Scott A Richmond
(74) *Attorney, Agent, or Firm* — Maginot, Moore & Beck, LLP

(57) ABSTRACT

An inkjet printer for printing on a continuous web of print media includes a calendering idler roll to reduce the amount of curl at an edge of the continuous web. The calendering idler roll indents the edge of the continuous web to create a predetermined bending stress in fibers of the web to roll out edge damage and to deform the fiber to create a bias in the fiber.

14 Claims, 6 Drawing Sheets

PRINTER HAVING EDGE CONTROL APPARATUS FOR WEB MEDIA

TECHNICAL FIELD

This disclosure relates generally to reducing damage to an edge of web media moving through a continuous web printer, and more particularly to reducing the amount of curl appearing at the edges of the web media prior to printing.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the imaging member. In these solid ink printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the image receiving surface can be a rotating surface, such as the surface of a rotating print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that must be operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

In order for the printed images to correspond closely to the image data, both in terms of fidelity to the image objects and the colors represented by the image data, the printheads are registered with reference to the image receiving surface and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer. Operating the printheads in a printer to eject ink in correspondence with image data presumes that the printheads are level with one another across a width of the image receiving member and that all of the inkjets in the printhead are operational.

Two or more printheads can be mounted linearly, or in other configurations, to a support structure, to form an array of printheads. Not only is registration between individual printheads important, but control of the registration of the supporting structure with respect to the image receiving surface is also desirable. The gap, or distance between support structure and the imaging surface, is controlled to optimize the imaging process. If the gap is too small, burnishing of the printheads can occur when the image receiving surface contacts the face of the printheads. Burnishing not only can reduce the life of the printheads, but can produce poor image quality and increased downtime of the printer during maintenance. If the gap it too large, image quality can suffer, particularly in high speed printers, where a large gap can result in the ink drops being deposited at unintended locations.

The setting of a proper gap is important where a printer is designed to accept a variety of imaging surfaces, including surfaces having a tendency to wrinkle, having different thicknesses, or having uneven surfaces. A thin layer of polytetrafluoroethylene (PTFE) is disposed on the printheads to provide accurate imaging. The PTFE layer controls the drooling pressure at the orifices of the printhead and should not be touched or burnished by wax or paper. If the PTFE is damaged, the drooling pressure can drop which in turn can alter the path of ejected ink drops as well as drooling, or dripping of ink during printing resulting from weak and missing inkjets.

Continuous web media is transported from a paper manufacturer to an end user as a roll of material. The outer edges of the web roll can be adversely affected during transportation due to shipping and handling. For instance either of the edges, which are often exposed, can be adversely affected. When the damaged edges move through the printer, the damaged edge can strike the face of the printhead due to the small gap between the surface of the print media and face of the printhead. These damaged edges can adversely impact the printheads. To reduce the risk of contact with the printheads, an operator typically cuts off about one inch of the outer edge of the web roll before mounting the web roll to the machine. While removing the outer one inch of material from the edges of the web roll can eliminate or substantially reduce damage to the printheads, this procedure is not desirable since both material and time are wasted.

SUMMARY

An apparatus for imaging a web of print media supported by a drum includes a calendering roll located at an edge of the web to reduce the amount of curl. The apparatus reduces the amount of curl forming at an edge of a recording media being transported through an inkjet printer in a process direction. The apparatus includes a drive roller and a first roller, wherein the recording media defines a width from a first edge to a second edge in a cross-process direction. The drive roller is operatively connected to the printer to transport the recording media through the printer and includes a first end, a second end, and a width disposed in the cross-process direction wherein the width is sufficient to support the first edge and the second edge of the recording media for transport through the printer. The first roller is disposed adjacent to the drive roller and defines a nip between the drive roller and the first roller. The first roller includes a width, a first end, a second end, and an intermediate portion located therebetween with the first end having an end diameter that is less than a diameter of the intermediate portion.

A printing apparatus includes a preheat drum supporting a continuous web of print media and a first spring loaded calendering roll and a second spring loaded calendering roll positionable at the edges of the web to reduce the amount of curl. A printing apparatus deposits ink on a continuous web of recording media moving in a process direction. The printing apparatus includes a printhead adapted to deposit the ink on the recording media. A drive roller is adapted to move the recording media past the printhead wherein the drive roller is configured to support a first edge and a second edge of the continuous web of recording media. A first roller is disposed adjacent to the drive roller and includes an end portion operably configured to be adjusted along a cross-process direction to a predefined location corresponding to an edge of the recording media. The first portion includes a first diameter smaller than a second diameter, wherein the first diameter can be adjusted to contact the driver roller while the second diameter contacts the recording media.

BRIEF DESCRIPTION OF THE DRAWINGS

The foregoing aspects and other features of a printer having an edge control apparatus for reducing the height of a damaged edge of web media are explained in the following description, taken in connection with the accompanying drawings.

DETAILED DESCRIPTION

Figure 1:
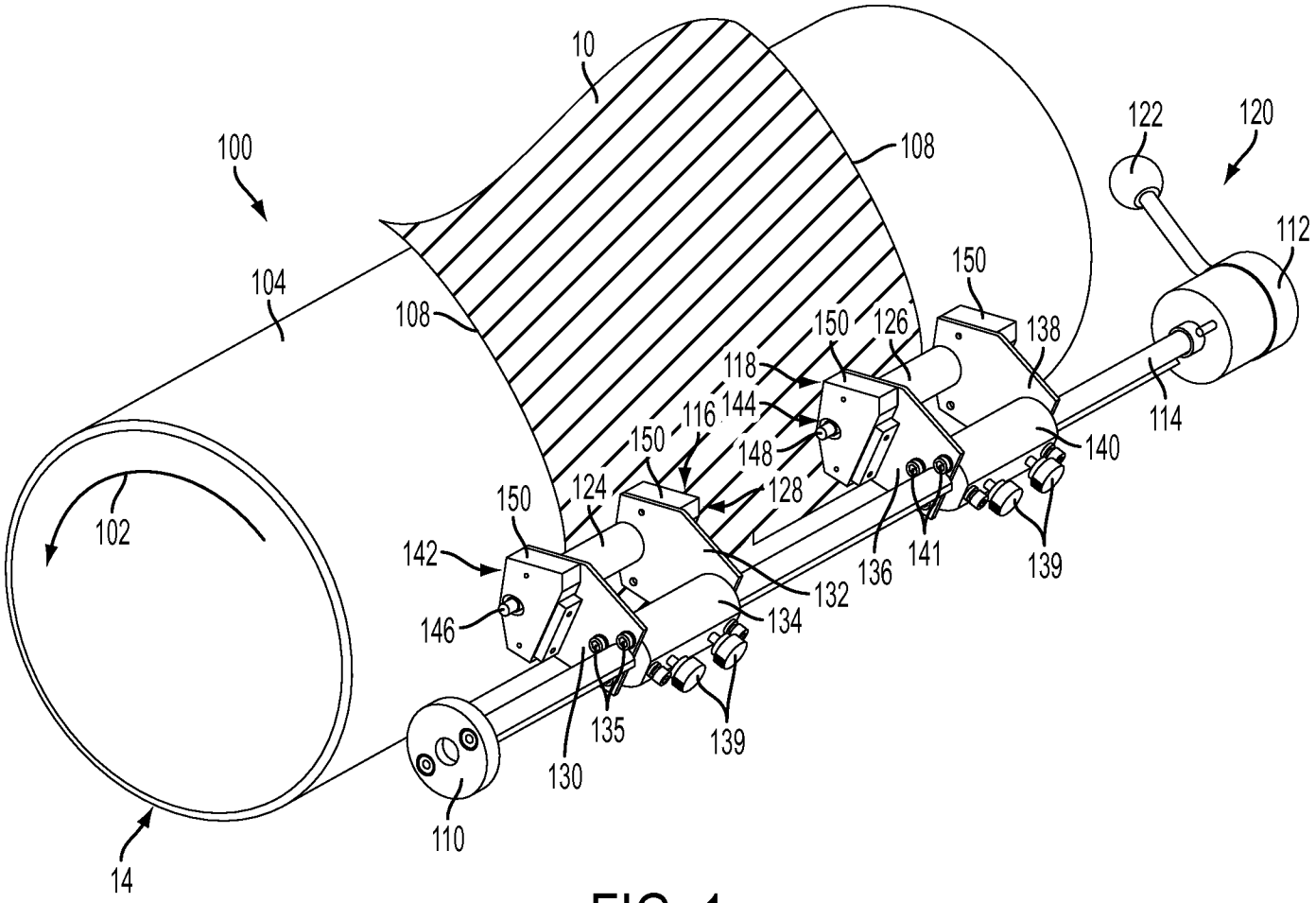
FIG. 1 is a perspective view of an edge control apparatus disposed adjacently to a preheat drum.

For a general understanding of the environment for the system and method disclosed herein as well as the details for the system and method, reference is made to the drawings. In the drawings, like reference numerals have been used throughout to designate like elements. As used herein the term "printer" refers to any device that is configured to form ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various print media including paper.

As used in this document, "ink" refers to a colorant that is liquid when applied to an image receiving surface. For example, ink can be aqueous ink, ink emulsions, solvent based inks and phase change inks. "Phase change ink" refers to inks that are in a solid or gelatinous state at room temperature and change to a liquid state when heated to an operating temperature for application or ejection onto the print media. The phase change inks return to a solid or gelatinous state when cooled on the print media after the printing process.

The term "printhead" as used herein refers to a component in the printer that is configured to eject ink drops onto an image receiving surface. A typical printhead includes a plurality of inkjets that are configured to eject ink drops of one or more ink colors onto the print media. The inkjets are arranged in an array of one or more rows and columns. In some embodiments, the inkjets are arranged in staggered diagonal rows across a face of the printhead. Various printer embodiments include one or more printheads that form ink images on the print media.

Figure 7:
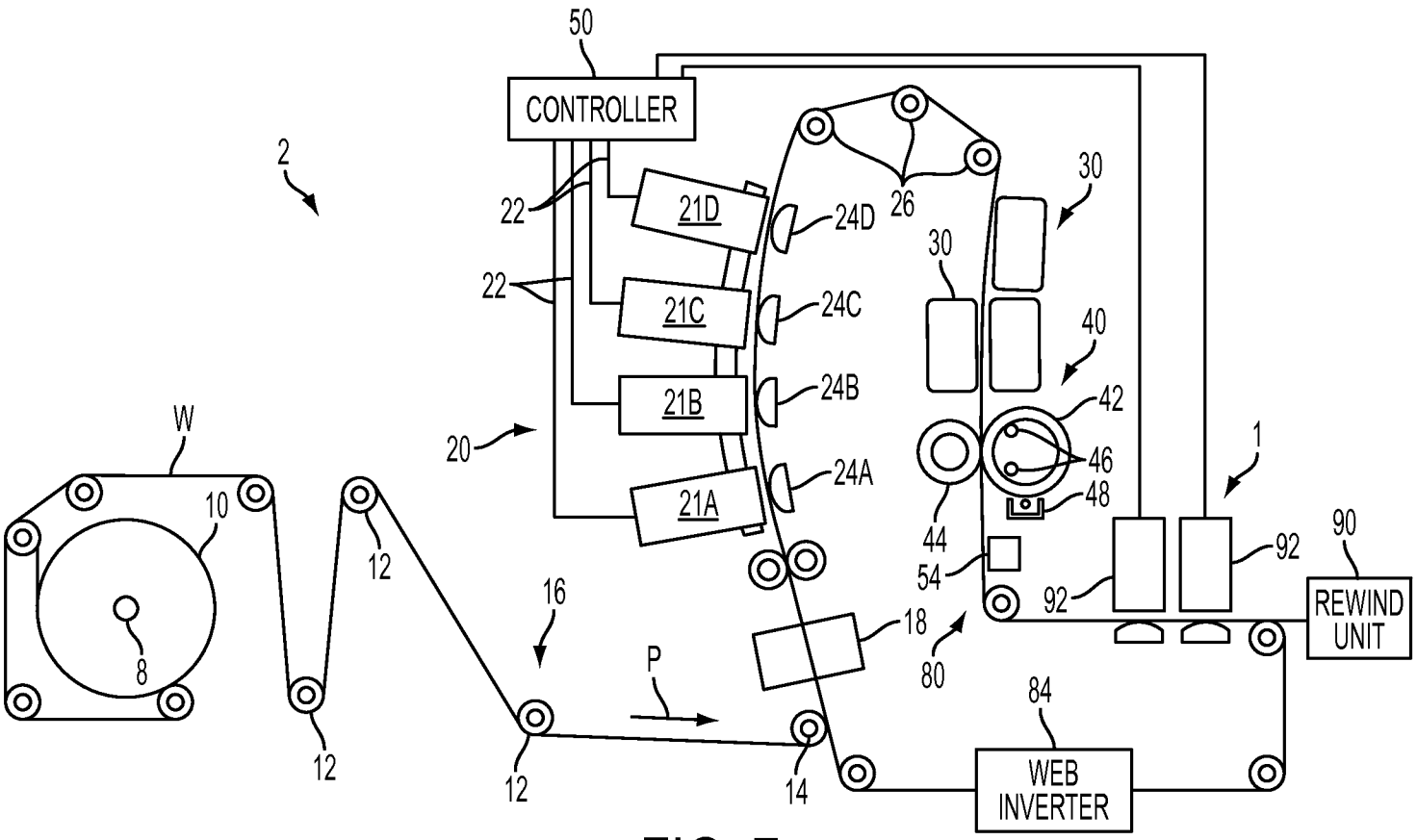
FIG. 7 (PRIOR ART)
FIG. 7 is a schematic view of a prior art inkjet imaging system that ejects ink onto a continuous web of media as the media moves past the printheads in the system.

FIG. 7 is a prior art inkjet printer that ejects ink onto a continuous web of media as the media moves past the printheads in the system. An embodiment of a printer, such as a high-speed phase change ink printer 2 in which the method and apparatus for reducing the height of a damaged edge of continuous web of media, is depicted. For the purposes of this disclosure, the inkjet printer 2 of FIG. 7 employs one or more inkjet printheads and an associated solid ink supply. The imaging apparatus includes a print engine to process the image data before generating the control signals for the inkjet ejectors. The colorant can be ink, or any suitable substance that includes one or more dyes or pigments that can be applied to the selected media. The colorant can be black, or any other desired color, and a given imaging apparatus can be capable of applying a plurality of distinct colorants to the media.

FIG. 7 is a simplified schematic view of a direct-to-sheet, continuous-media, phase-change inkjet printer 2, that can be modified to include an apparatus and method for reducing the height of a damaged edge of continuous web of media. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 1, and rewind unit 90. For duplex operations, a web inverter 84 is used to flip the web over to present a second side of the media to the printing station 20, printed web conditioner 80, and coating station 1 before being taken up by the rewind unit 90. In the simplex operation, the media source 10 has a width that covers a portion of the width of the rollers over which the media travels through the printer. In duplex operation, the media source is approximately one-half of the roller widths as the web travels over one-half of the rollers in the printing station 20, printed web conditioner 80, and coating station 1 before being flipped by the inverter 84 and laterally displaced by a distance that enables the web to travel over the other half of the rollers opposite the printing station 20, printed web conditioner 80, and coating station 1 for the printing, conditioning, and coating, if necessary, of the reverse side of the web. The rewind unit 90 is configured to wind the web onto a roller for removal from the printer and subsequent processing.

The media can be unwound from the source 10 as needed and propelled by a variety of motors (not shown) rotating one or more rollers. The media conditioner includes rollers 12, preheat drum 14, and a pre-heater 18. Preheat drum 14 and pre-heater 18 can both be included in the printer 2 or one or the other can be eliminated such that only one preheater remains. If preheat drum 14 is eliminated, a roller of the type used for rollers 12 can be used instead. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along a desired path through the imaging device. The preheat drum 14 and the pre-heater 18 bring the web to an initial predetermined temperature that is selected for desired image characteristics corresponding to the type of media being printed as well as the type, colors, and number of inks being used. The preheat drum 14 can be driven by a motor and can be considered a drive roller. The preheat drum 14 generally provides contact heat provided by a heating device disposed within the preheat drum 14. The pre-heater 18 can use contact, radiant, conductive, or convective heat to bring the media to a target preheat temperature. In one practical embodiment, the preheat temperature is in a range of about 30 degrees C. to about 70 degrees C.

The media is transported through a printing station 20 that includes a series of printhead modules, which are sometimes known as print box units, 21A, 21B, 21C, and 21D, each printhead module effectively extending across the width of the media and being able to place ink directly (i.e., without use of an intermediate or offset member) onto the moving media. A printhead module can include one or more printheads operatively connected to a frame and aligned thereon for depositing ink to form an image. The printhead module can include associated electronics, ink reservoirs, and ink conduits to supply ink to the one or more printheads. Any one, some, or all of the printhead modules 21A-21D can be angled with respect to horizontal. As is generally familiar, each of the printheads of the printhead array can eject a single color of ink, one for each of the colors typically used in color printing, namely, cyan, magenta, yellow, and black (CMYK).

The controller 50 of the printer receives velocity data from encoders mounted proximately to rollers positioned on either side of the portion of the path opposite the four printheads to compute the position of the web as it moves past the printheads. The controller 50 uses these data to generate timing signals for actuating the inkjet ejectors in the printheads to enable the four colors to be ejected with a reliable degree of accuracy for registration of the different color patterns to form four primary-color images on the media. The inkjet ejectors actuated by the firing signals corresponds to image data processed by the controller 50. The image data can be transmitted to the printer, generated by a scanner (not shown) that is a component of the printer, or otherwise generated and delivered to the printer. In various possible embodiments, a printhead module for each primary color can include one or more printheads; multiple printheads in a module can be formed into a single row or multiple row array; printheads of a multiple row array can be staggered; a printhead can print more than one color; or the printheads or portions thereof can be mounted movably in a direction transverse to the process direction P, such as for spot-color applications and the like.

The printer 2 uses "phase-change ink" as that term has been previously defined above. Associated with each printhead module is a backing member 24A-24D, typically in the form of a bar or roll, which is arranged substantially opposite the printhead on the back side of the media. Each backing member is used to position the media in front of the printhead opposite the backing member. Each backing member can be configured to emit thermal energy to heat the media to a predetermined temperature which, in one practical embodiment, is in a range of about 40 degrees C. to about 60 degrees C. The various backer members can be controlled individually or collectively as part of the media transport. The pre-heater 18, the printheads, backing members 24 (if heated), as well as the surrounding air, combine to maintain the media along the portion of the path opposite the printing station 20 in a predetermined temperature range of about 40 degrees C. to 70 degrees C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore, other temperature regulating devices can be employed to maintain the media temperature within a predetermined range. For example, the air temperature and air flow rate behind and in front of the media can also impact the media temperature. Accordingly, air blowers or fans can be utilized to facilitate control of the media temperature. Thus, the media temperature is kept substantially uniform for the jetting of all inks from the printheads of the printing station 20. Temperature sensors (not shown) can be positioned along this portion of the media path to enable regulation of the media temperature. Temperature data can also be used by systems for measuring or inferring (from the image data, for example) how much ink of a given primary color from a printhead is being applied to the media at a given time.

Following the printing zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35 degrees C. to about 80 degrees C. The mid-heater 30 has the effect of equalizing the ink and substrate temperatures to within about 15 degrees C. of each other. Lower ink temperature gives less line spread while higher ink temperature causes show-through (visibility of the image from the other side of the print). The mid-heater 30 adjusts substrate and ink temperatures to 0 degrees C. to 20 degrees C. above the temperature of the spreader.

Following the mid-heaters 30, a fixing assembly 40 is configured to apply heat and/or pressure to the media to fix the images to the media. The fixing assembly can include any suitable device or apparatus for fixing images to the media including heated or unheated pressure rollers, radiant heaters, heat lamps, and the like. In the embodiment of the FIG. 7, the fixing assembly includes a "spreader" 40, which applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 can also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35 degrees C. to about 80 degrees C. In alternative embodiments, the fixing assembly can be configured to spread the ink using non-contact heating (without pressure) of the media after the print zone. Such a non-contact fixing assembly can use any suitable type of heater to heat the media to a desired temperature, such as a radiant heater, UV heating lamps, and the like.

In one embodiment, the roller temperature in spreader 40 is maintained at a temperature to an optimum temperature that depends on the properties of the ink, such as 55 degrees C. Generally, a lower roller temperature gives less line spread while a higher temperature causes imperfections in the gloss. Roller temperatures that are too high can cause ink to offset to the roll. In one practical embodiment, the nip pressure is set in a range of about 500 to about 2000 psi lbs./side. Lower nip pressure gives less line spread while higher pressure can reduce pressure roller life.

The spreader 40 can also include a cleaning/oiling station 48 associated with image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature as it is printed to enable spreading of the ink.

The coating station 1 applies a clear ink to the printed media. This clear ink helps protect the printed media from smearing or other environmental degradation following removal from the printer. The overlay of clear ink acts as a sacrificial layer of ink that can be smeared and/or offset during handling without affecting the appearance of the image underneath. The coating station 1 can apply the clear ink with either a roller or a printhead 92 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating can be formed using a reduced set of typical solid ink components or a single solid ink component, such as polyethylene wax, or polywax. As used herein, polywax refers to a family of relatively low molecular weight, straight chain, poly ethylene or poly methylene waxes. Similar to the colored phase change inks, clear phase change ink is substantially solid at room temperature and substantially liquid or melted when initially jetted onto the media. The clear phase change ink can be heated to about 100 degrees C. to 140 degrees C. to melt the solid ink for jetting onto the media.

Following passage through the spreader 40, the printed media can be wound onto a roller for removal from the system (simplex printing) or directed to the web inverter 84 for inversion and displacement to another section of the rollers for a second pass by the printheads, mid-heaters, spreader, and coating station. The duplex printed material can then be wound onto a roller for removal from the system by rewind unit 90. Alternatively, the media can be directed to other processing stations that perform tasks such as cutting, binding, collating, and/or stapling the media or the like.

Operation and control of the various subsystems, components and functions of the printer 2 are performed with the aid of the controller 50. The controller 50 can be implemented with general or specialized programmable processors that execute programmed instructions. The instructions and data required to perform the programmed functions can be stored in memory associated with the processors or controllers. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The printer 2 can also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system can be a single light emitting diode (LED) that is operatively connected to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment can include three linear arrays, one for each of the colors red, green, and blue. Alternatively, all of the LEDS can be arranged in a single linear array in a repeating sequence of the three colors. The LEDs of the light source can be operatively connected to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array can be configured to translate across the image substrate. For example, the linear array can be mounted to a movable carriage that translates across image receiving member. Other devices for moving the light sensor can also be used.

FIG. 1 is a perspective view an edge control apparatus 100 disposed adjacently to the preheat drum 14. The preheat drum rotates in a counterclockwise direction 102, as illustrated, to preheat the recording media 10 and to move the heated recording media 10 past the printbox units 21 for printing. The media 10 moves between a surface 104 of the preheat drum 14 and the edge control apparatus 100 disposed adjacently to the preheat drum 14. The edge control apparatus 100 contacts outer or side edges 108 defining the cross-process width of the media 10, also known as a web zone. The cross-process width of the media 10 can include any number of widths and is limited only by the capability of the print box units 21 to deposit ink in the cross-process direction.

The edge control apparatus 100 includes a first mount 110 and a second mount 112 each of which is operatively connected to the frame (not shown) of the printer 2. A shaft 114 extends in the cross-process direction from the first mount 110 to the second mount 112. The shaft 114 supports a first edge calendering device 116 and a second edge calendering device 118 in close proximity to the surface 104 of the preheat drum 14. The second mount 112 includes an actuator 120 configured with a handle 122 to enable adjustment of the distance between a first roller, or roll, 124 of the first edge calendering device 116 and a second roller, or roll, 126 of the second edge calendering device 118 to the surface 104 of the preheat drum 14. Each of the rollers 124 and 126 define a nip with the surface 104 of the preheat drum 14 through which the edges 108 of the web 10 are directed during imaging of the media. As used herein, calendering describes the one roller defining a nip with another roller to form or smooth a web or sheet of material including print media.

The nips located between the surface 104 of the preheat drum 14 and the rollers 124 and 126 provide a mechanism to reverse curl the edges 108 of the media 10. Roller 124 is supported for substantially free rotation by a frame 128, which includes a first side plate 130, a second side plate 132, and a slider 134. The first and second side plates 130 and 132 are fixedly coupled to the ends of the slider 134 with screws 135 and extend at substantially right angles to an axis of the slider 134 to position the roller 124 substantially parallel to the surface 104 of the heated drum 14. The slider 134 is generally cylindrical and includes a channel through which the shaft 114 is inserted. The channel is sufficiently large to enable positionable movement of the slider in the cross-process direction such that the edge roller 124 can be positioned to produce the nip at the edge of the media 10.

The second edge calendering device 118, includes similar components as the first edge calendering device 116, and supports the roller 126 with first and second side plates 136 and 138 each fixedly coupled to the ends of a slider 140 with screws 141. Other means of fixing side plates to the sliders can also be used such as spot welds and adhesives. The roller 126 is positioned substantially parallel to the surface 104 of the preheat drum 14 to provide a second nip to engage the other edge of the web media 10. Each of the sliders 134 and 140 includes threads to engage set screws 139. Once the sliders are appropriately located at predefined locations to contact the edges of the web, the set screws 139 can be tightened to engage the shaft 114 to fix the position of the slider.

Each of the rollers 124 and 126 are spring biased, or spring loaded, against the surface 104 of the preheat drum 14 to provide a predetermined amount of force at the nips. By compressing the media 10 between the surface 104 and the roller 124 or 126, a bending stress is applied to the edges of the media. For instance, the bending stress for paper having a paper weight of 75 gsm (grams per square meter) using a roller with a diameter of one inch is approximately 2000 psi or 2800 psi total in outer fiber stress including tension. As the nip roller diameter becomes smaller (i.e. rollers 124 and 126), the bending stress becomes higher. With a higher nip force, strain energy increases in the nip area. The combination of bending, axial stress, and strain energy or creep stress can roll out damaged edges of the media and reduce the height of the edge asperity, crease, bulge, and riser. In one embodiment, a die spring providing fifty (50) lbs. of force can be used. The spring pressure can be varied to suit the paper thickness and edge damage.

A spring bias is applied to each end of each of the rollers 124 and 126. Each roller includes respectively a spindle 142 and 144 about which the rollers freely rotate. Rollers 124 and 126 can also be motor driven. Spindle 142 includes a first end 146 and a second end (not shown). Spindle 144 includes a first end 148 and a second end (not shown). Each of the first ends and second ends are spring biased within end housings 150. Springs support the ends of the spindles thereby enabling each end to respond independently of the other. The independent springs gimbal the rollers to lay flat on the web so as not to steer or wrinkle the media. By applying the rollers to the edges of the media, the height of a damaged edge can be reduced by approximately 50% or more. Because the height of an edge should be at least less than the gap between the printhead surface and the media, the edges are at a height of less than approximately 0.4 millimeters in most embodiments. A height sensor can measure the height of the asperity and the improvement after the rollers have been engaged to reduce the curl at the edges of the web. In one embodiment, the height sensor can include a sensor apparatus including a laser transmitter and receiver or reflector such as that described in U.S. Patent Publication 2011/0279507 entitled "Media Handling Device for a Printer".

Figure 2:
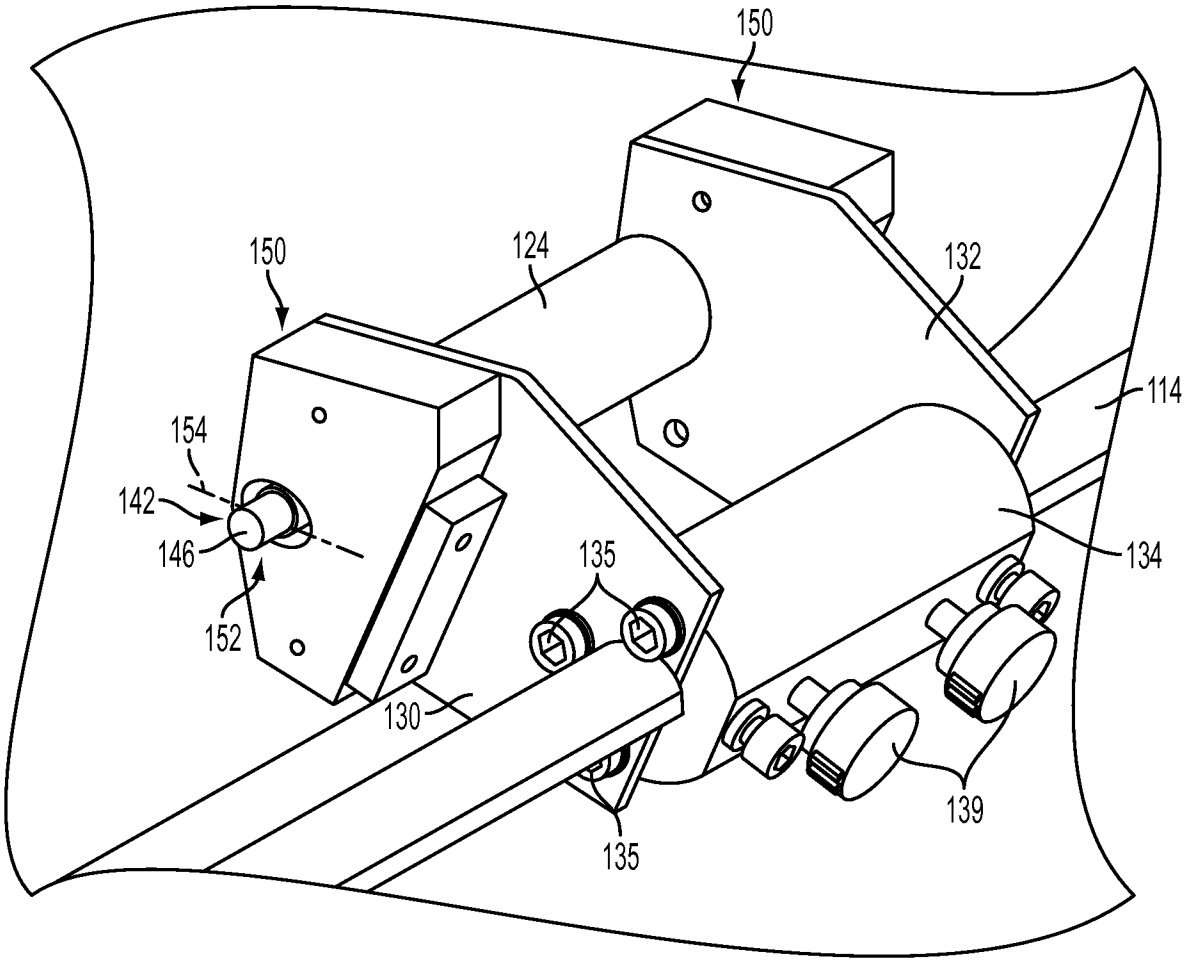
FIG. 2 is a perspective view of an edge calendering device.

FIG. 2 is a perspective view of the edge calendering device 116 located at a fixed position on the shaft 114. As previously described, the edge calendering device 116 supports the roller 124 for rotational movement about the spindle 142, which is supported at each end by the housings 150. Each of the housings 150 are mounted to the side plates and include an aperture 152 through which the ends of the spindles extend. Because the rollers and therefore the spindles are spring biased to forcefully engage the surface 104 of the heated drum 14, the aperture 152 generally defines a slot having a length longer than the width where a line 154 defining the length is generally perpendicular to a tangent of the surface of the drum 14. The slot shaped aperture 152 enables the roller to gimble in two directions, either toward or away from the surface 104. By maintaining the movement of the roller substantially perpendicular to the tangent of the surface, the force provided by the spring biased rollers and applied to the edges of the media can be maximized.

Figure 3:
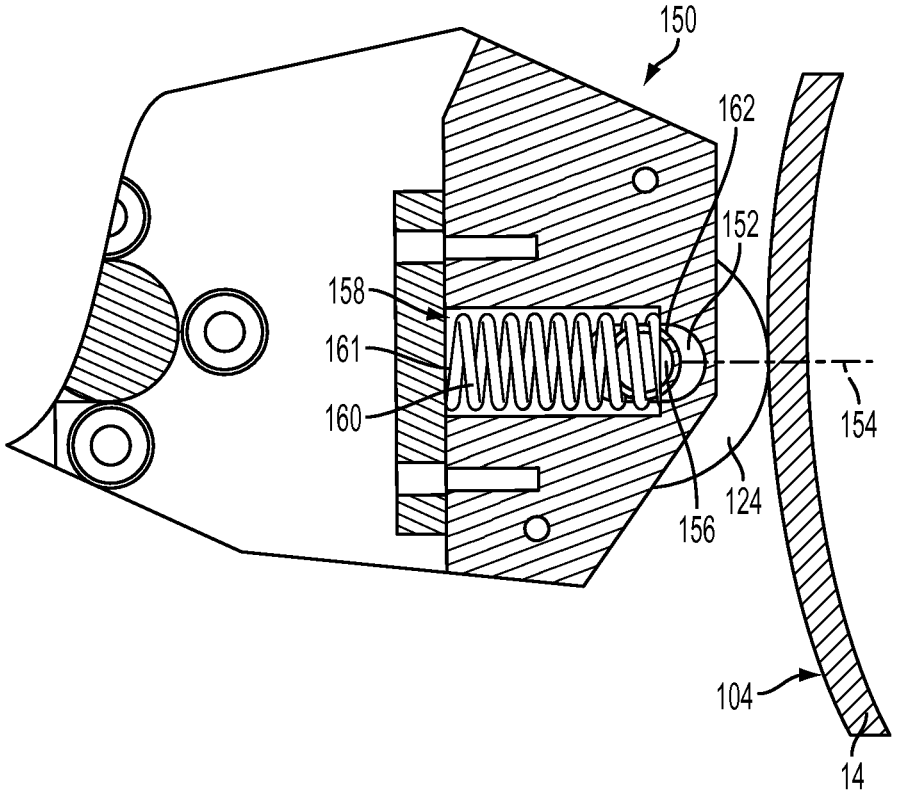
FIG. 3 is a side elevational view of a portion of the edge calendaring device including a roller in contact with a preheat drum.

FIG. 3 is side elevational view of a portion of the edge roller device with the roller 124 in contact with a preheat drum 14. In FIG. 3, a cover of the housing 150 has been removed to reveal the slotted aperture 152 and a second end 156 of the spindle 142. The housing 150 includes a cavity 158 having a size sufficient to hold a spring 160 or other resilient biasing device. The cavity includes a first end and a second end to engage a first end 161 and a second end 162 of the spring 160. End 162 of the spring 160 is operatively connected to the second end 156 of spindle 142 to force the spindle and therefore the roller 124 towards the surface 104. Each of the housings 150 are similarly formed and include springs located within cavities to support ends of spindles to provide spring force to the rollers.

Figure 4:
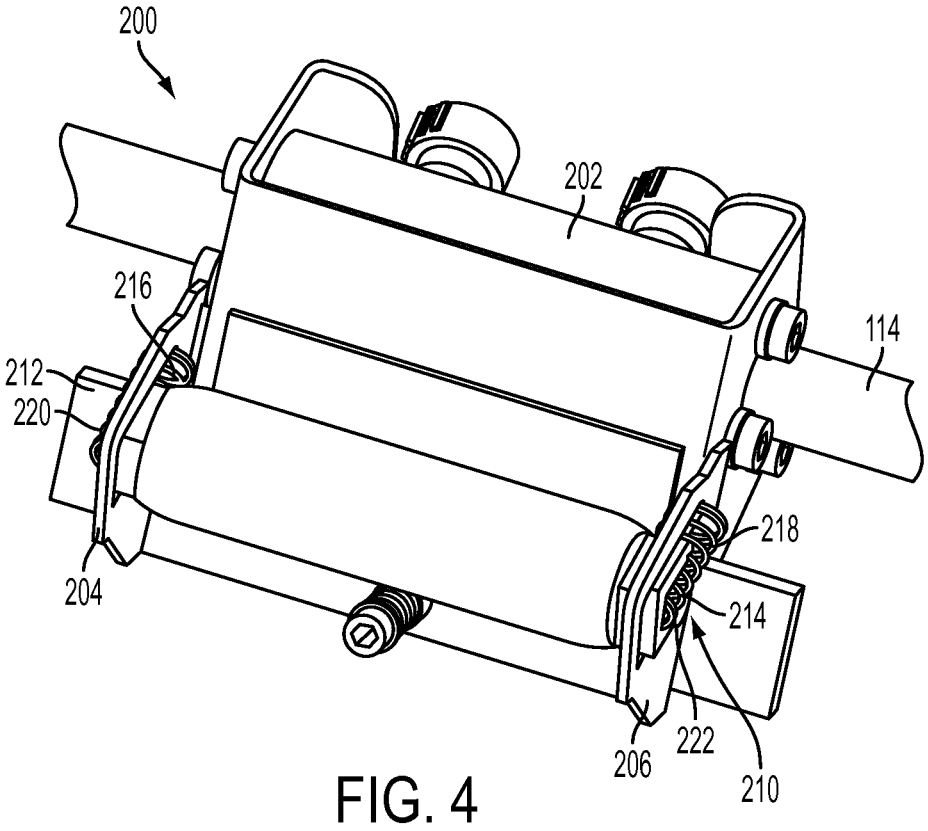
FIG. 4 is a front perspective view of another embodiment of an edge calendering device.

FIG. 4 is a front perspective view of another embodiment of an edge calendering device 200. The device 200 includes a frame 202 having a first side plate 204 and a second side plate 206 to support a roller 208 for rotational movement about a spindle 210. A first end 212 and a second end 214 are supported respectively by a first spring 216 and a second spring 218. The first spring 216 and the second spring 218 are operatively connected to the first and second side plates 204 and 206 at support features 220 and 222, respectively.

Figure 5:
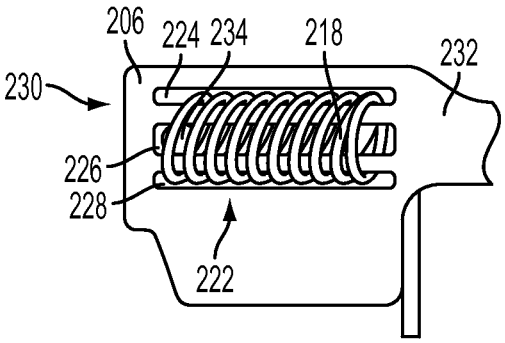
FIG. 5 is a plan view of a support feature for a spring including first, second, and third apertures.

As illustrated in FIG. 5, support feature 222 includes first, second, and third apertures 224, 226, and 228 each of which are configured as a slot extending from an end 230, positioned towards the drum 14, and an end 232, positioned towards the shaft 114. The first aperture 224 and the third aperture 228 hold the spring 218 and are separated by the second aperture 226. An end of the spring 234 is operatively connected to second end 214 of the spindle 210. The first side plate includes support feature 220, which includes first, second, and third apertures, as described with respect to support feature 222, to support spring 216. The ends of the spindle 210 are biased towards the heated drum 14 (not shown) as previously described with respect to FIGS. 1, 2, and 3.

Figure 6:
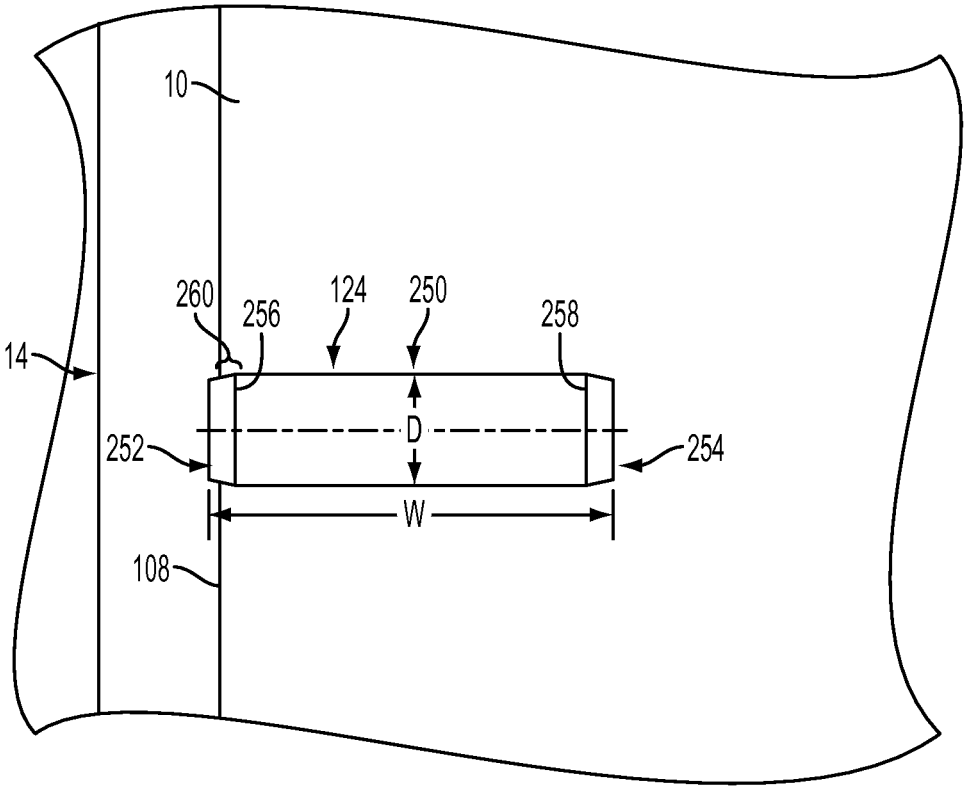
FIG. 6 is a schematic front view of an edge calendering roll disposed at an edge of print media.

FIG. 6 is a schematic front view of edge calendering roll 124 of FIGS. 1-3. The roll 124 is illustrated in a curl-reducing position disposed at the edge 108 of the media 10. (See FIG. 1). The roll 124 includes a width, W, disposed in the cross-process direction, and a diameter, D, disposed in the process direction and generally defined at a center 250 of the roll. In one embodiment, the width W is approximately 50.8 millimeters, and the diameter D approximately 26 millimeters. The roll also includes a first end 252 and a second end 254 each of which includes an end diameter of approximately 25.5 millimeters. Each diameter at the ends 252 and 254 are less than the diameter measured at the center of the roll. The diameter D of 26 millimeters continues from the center to approximately 6 millimeters from the ends along a line 256 and 258. The diameter of 26 millimeters at the lines 256 and 258 tapers from the lines 256 and 258 to the ends 252 and 254 where each of the diameters measure approximately 25.5 millimeters. An intermediate portion located between the lines 256 and 258 generally includes the same diameter from line 256 to line 258, which in the illustrated embodiment is substantially the same as the diameter of the center 250.

As previously described one end of each of the calendering rolls is placed at predefined locations with respect to the driver drum to contact the edges 108 of the media for printing. To provide reduced curl, a surface of the roll located between the end 252 and the line 256 is positioned at the anticipated location of the edge 108 of the media. By placing an end portion 260, the portion between the minimum and a larger diameter of the roll to contact the edge of the roll 124, edge curl is reduced. Before printing, the operator positions the end portion 260 on the edge 108 such that approximately 25 percent of the end portion 260 is not contacting the media 10 and approximately 75 percent of the edge portion 260 is in contact with the media 10. While this embodiment places the edge 108 of the media beneath the roll 124 at this particular location, other locations are possible. For instance, in other embodiments, the portion 260 can include a length of other than six (6) millimeters and the change in diameter from the center 250 of the roll to the end 252 can be other than described. For instance, an end portion having a continuously decreasing diameter towards the end of the roll can be applied to an edge to reduce curl even if other locations of the roll include a diameter of less than the largest diameter of the end portion. The selected diameters and the length of the portion 260 including the diminishing diameter is selected to reduce the height of a damaged edge approximately 40 percent or more or an amount sufficient to substantially prevent burnishing of the printheads.

The edge calendaring device 100, while being described to reduce curl at the preheat drum 14, can also be located adjacent to other drive rollers to reduce edge curl. For instance, the edge calendering device 100 can provide a nip with the rollers 12 located before the web media 10 moves beneath the printheads. While the preheat drum includes a metal surface, other rollers can include a rubber surface. Because the high spring force at the nip roller could indent the rubber surface of a drive roller, the nip roller can be disengaged from the surface during extended periods of downtime. In some embodiments, the edge calendaring device can be operatively connected to an electronically controlled air cylinder and retracted for extended periods of time. If the edge calendering device is positioned at the preheat drum 14, then engagement can continue until a new roll of web media is placed in the printer. In other embodiments, the edge calendering rollers include one end having an edge portion that diminishes in diameter towards the end of the roller, while the other end not located at the edge of the web media does not become smaller at the end.

It will be appreciated that several of the above-disclosed and other features, and functions, or alternatives thereof, can be desirably combined into many other different systems or applications. Various presently unforeseen or unanticipated alternatives, modifications, variations, or improvements therein can be subsequently made by those skilled in the art, which are also intended to be encompassed by the following claims.

What is claimed is:

1. An apparatus for reducing the amount of curl forming at an edge of a recording media being transported through an inkjet printer in a process direction, the recording media defining a width from a first edge to a second edge in a cross-process direction, the apparatus comprising:

a drive roller operatively connected to the printer to transport the recording media through the printer, the drive roller having a surface defined at a constant diameter and sized to support the first edge and the second edge of the recording media for transport through the printer;

a first roller, disposed adjacent to the drive roller defining a nip between the drive roller and the first roller, the first roller including a surface contacting the recording media, the surface having a width, a first end, a second end, and an intermediate portion located therebetween, the first roller at said first end having an end diameter that is less than a diameter of said first roller at the intermediate portion.

2. The apparatus of claim 1 wherein the first roller is positionable along the cross-process direction for placement of the first end at a predefined location adjacent to the drive roller, the predefined location corresponding to a location of one of the first edge and the second edge of the recording media.

3. The apparatus of claim 2 further comprising a second roller disposed adjacent to the drive roller defining a nip therebetween, the second roller including a width, a first end, a second end, and an intermediate portion located therebetween, the first end having an end diameter that is less than a diameter of the intermediate portion.

4. The apparatus of claim 3 wherein the second roller is positionable along the cross-process direction for placement of the first end at a predefined location adjacent to the drive roller, the predefined location corresponding to a location of the other of one of the first edge and the second edge of the recording media.

5. The apparatus of claim 4 further comprising:

a first frame operatively connected to the first roller, the first frame including a first biasing element to spring bias the first roller to the first frame; and a second frame operatively connected to the second roller, the second frame including a second biasing element to spring bias the second roller to the second frame.

6. The apparatus of claim 5 wherein the first biasing element of the first frame includes a first spring located at the first end of the first roller and a second spring located at the second end of the first roller, the first spring and the second spring being independently actuable to spring bias the first roller against a surface of the driver roller.

7. The apparatus of claim 6 wherein the second biasing element of the second frame includes a third spring located at the first end of the second roller and a fourth spring located at the second end of the second roller, the third spring and the fourth spring being independently actuable to spring bias the second roller against the surface of the drive roller.

8. The apparatus of claim 7 further comprising:

a support operatively connected to the printer, the first frame and the second frame being adjustably operatively connected to the support to enable adjustment of the first frame and the second frame along the cross-process direction for alignment with respect to predefined locations corresponding to the location of the first edge and the second edge of the recording media.

9. The apparatus of claim 8 wherein the diameter of the first roller continuously decreases from the intermediate portion to one of the first end and the second end of the first roller.

10. The apparatus of claim 9 wherein the diameter of the second roller continuously decreases from the intermediate portion to one of the first end and the second end of the second roller.

11. The apparatus of claim 10 wherein the first edge and the second edge of the recording media define a media zone and the first end of the first roller is locatable outside the media zone.

12. The apparatus of claim 11 wherein the first roller includes an end portion defined by the end diameter and a second diameter displaced from the end diameter which is larger than the end diameter.

13. The apparatus of claim 12 wherein the second roller includes an end portion having the end diameter and a second diameter displace from the end diameter which is larger than the end diameter.

14. The apparatus of claim 13 further comprising:

an engagement mechanism operatively connected to the support and to the printer to move the first roller and the second roller into and out of engagement with the drive roller.

* * * * *